US005692726A

United States Patent [19]

Adachi et al.

[11] Patent Number: 5,692,726

[45] Date of Patent: Dec. 2, 1997

[54] BONDED VALVE SEAT

[75] Inventors: Shuhei Adachi; Junichi Inami, both of Iwata, Japan

[73] Assignee: Yamaha Hatsudoki Kabushiki Kaisha, Iwata, Japan

[21] Appl. No.: 645,025

[22] Filed: May 15, 1996

[30] Foreign Application Priority Data

May 15, 1995 [JP] Japan ..... 7-115809

[51] Int. Cl.[6] ..... F02H 3/00

[52] U.S. Cl. ..... 251/368; 251/359; 123/188.3; 123/188.8

[58] Field of Search ..... 251/368, 359; 123/188.8, 188.3

[56] References Cited

U.S. PATENT DOCUMENTS

| | | | |
|---|---|---|---|
| 2,753,859 | 7/1956 | Bartlett | 123/188.8 |
| 4,092,223 | 5/1978 | Kaufman . | |
| 4,422,875 | 12/1983 | Nalsata et al. | 123/188.8 |
| 4,424,953 | 1/1984 | Takagi et al. | 251/368 |
| 4,546,737 | 10/1985 | Kazuoka et al. | 123/188.8 |
| 4,671,491 | 6/1987 | Kuroishi et al. | 123/188.8 |
| 4,723,518 | 2/1988 | Kawasaki et al. | 123/188.8 |
| 5,031,878 | 7/1991 | Ishikawa et al. | 123/188.8 |
| 5,260,137 | 11/1993 | Rosenthal et al. . | |
| 5,431,136 | 7/1995 | Kenmoku et al. | 123/188.3 |
| 5,495,837 | 3/1996 | Mitsuhashi et al. | 123/188.3 |

FOREIGN PATENT DOCUMENTS

| | | |
|---|---|---|
| 0092683 | 11/1983 | European Pat. Off. . |
| 4036614 | 5/1991 | Germany . |
| 9427767 | 12/1994 | WIPO . |

OTHER PUBLICATIONS

Patent Abstracts of Japan, vol. 010, No. 246 (M-510), 23 Aug. 1986 European Search Report dated Aug. 29, 1996.

*Primary Examiner*—A. Michael Chambers

*Attorney, Agent, or Firm*—Knobbe, Martens, Olson & Bear LLP

[57] ABSTRACT

A valve seat insert for use in forming a metallurgically bonded valve seat for a light alloy casting. The valve seat insert is comprised of a base formed from a sintered material selected from the group of ferrous, copper or nickel and is provided with a coating selected from the group of copper, tin, zinc, silicon, aluminum or silver or an alloy thereof. The coating forms an eutectic alloy with the aluminum of the cylinder head which eutectic alloy has a melting point lower than that of either the aluminum or the coating.

11 Claims, 8 Drawing Sheets

BONDED VALVE SEAT

BACKGROUND OF THE INVENTION

This invention relates to a bonded valve seat and more particularly to an improved valve seat insert for use in forming such a valve seat.

In internal combustion engines as well as other reciprocating machines, it is frequently the practice to employ a valve seat which is formed in the cylinder head from a material that is different from the base material of the cylinder head. The use of such valve seats, normally formed from inserts, is to improve the wear resistance capability of the valve seat from the remainder of the cylinder head material. Conventionally, these forms of valve seats are formed by separate insert rings that are pressed in place into the cylinder head. There are a number of disadvantages to the use of such pressed in valve seat inserts.

One of the main disadvantages is that the insert does not have good heat transfer capability with the remainder of the cylinder head for a variety of reasons. Thus, the valves and valve seats tend to run at a higher than desirable temperature requiring the use of heavier and stronger valves which reduces the permissible speed of the engine. Another disadvantage with this type of construction is that a rather large area is required between adjacent valves to avoid the possibility of cylinder head cracking due to the pressing forces. Thus, it is not possible to use maximum valve seat area and maximum flow areas to improve the performance of the machine. In addition, the use of such inserts requires a relatively large inserting which, itself, comprises the shape of the passages which serve the combustion chamber. In addition to these disadvantages, there are a number of other like disadvantages.

In order to avoid these problems, the inventors hereof have proposed a different form of valve seat arrangement. With this different form of valve seat arrangement, a smaller insert ring can be employed and the insert ring is metallurgically bonded to the cylinder head material. As a result, heat transfer is improved, the inserts can be made smaller and the valves larger, and the likelihood of displacement of the inserts during engine running is substantially reduced, if not totally eliminated.

The way the insert ring is metallurgically bonded into the cylinder head is by pressing the insert ring into the cylinder head and passing an electrical current through it so as to elevate the temperature of the cylinder head material. The temperature elevation is such, however, that there is no alloying of the insert ring material to that of the cylinder head.

It has been found that conventional welding techniques have a number of disadvantages similar to those of pressed in inserts. The largest of these disadvantages is the formation of voids or discontinuities in the area between the insert ring and the cylinder head that reduce heat transfer and, thus, result in high operating temperatures of the valve.

Thus, it should be readily apparent that it is desirable to reduce the amount of heat generated in the area during the bonding process. This will ensure against alloying of the insert ring material and the cylinder head material to any significant extent.

It has been proposed to provide a coating on the insert ring which coating will form a eutectic alloy with the cylinder head material. This arrangement has a number of advantages. First, the eutectic alloy can be displaced out of the bonded area upon the application of pressure so as to, in effect, clean the bonding area and remove it from impurities. In addition, by viewing the displacement of the eutectic material it is possible to make a visual inspection that can determine any voids the bond. In addition, this methodology has been found to remove other surface impurities from the base casting of the cylinder head and, thus, provides a metallurgically improved structure.

Furthermore, the bonding process forms a work hardening of the cylinder head material around the bonded area and further improves the strength of the resulting structure without the formation of alloys.

It has been discovered by the Applicants that the selection of the proper coating material can result in the formation of a eutectic alloy between the coating and the cylinder head which has a lower melting point than either of the base materials of the coating and the cylinder head. This further promotes the bonding process.

It is, therefore, a principal object of this invention to provide an improved valve seat insert that can be utilized for this bonding technique.

It is a yet further object of this invention to provide an improved valve seat insert for use in forming bonded valve seats having an improved coating and base material so as to improve the performance of the resulting valve seat.

It is a further object of this invention to provide an improve coating and base material for the valve seat insert which will provide the desired mechanical properties of the final valve seat.

SUMMARY OF THE INVENTION

This invention is adapted to be embodied in a valve seat insert for forming an electric resistance heated, bonded valve seat with a casting formed from a first material selected from the group of aluminum and aluminum alloys. The valve seat insert is comprised of a base that is formed from a second material that is formed from the group of sintered ferrous, copper and nickel. A coating is formed on at least the surface of the base that is to be bonded to the casting and is formed from a third material selected from the group of copper, tin, zinc, silver, aluminum or silicon or alloys thereof. The third material forms a eutectic alloy with the first material which has a lower melting point than that of either of the first or third materials.

DETAILED DESCRIPTION OF THE PREFERRED EMBODIMENTS OF THE INVENTION

Figure 1:
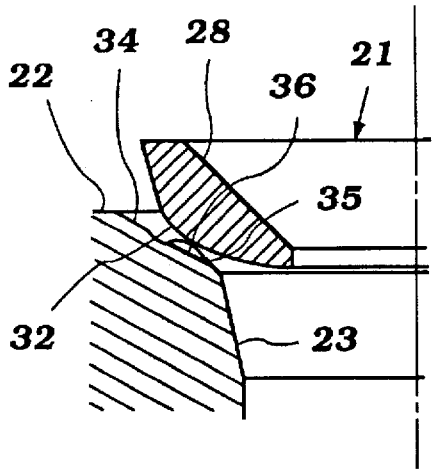
FIGS. 1–6 are step-by-step cross-sectional views showing the steps in pressing in and bonding a valve seat insert in accordance with the invention with FIG. 1 showing the initial step and FIG. 6 showing the final machined valve seat.

Before discussing the specific metallurgical constituent of the various components and the advantages of the utilization of the eutectic alloy, the basic bonding process will be described by particular reference to FIGS. 1–9. The process involves the bonding of an insert ring, indicated generally by the reference numeral 21, into place in a cylinder head, indicated generally by the reference numeral 22. The resulting valve seat is formed at the place where a cylinder head flow passage 23 meets the combustion chamber recess of the cylinder head 22. A poppet type valve, not shown, controls the opening and closing of the valve seat. This construction may be used at either or both of the intake and/or exhaust passages.

Figure 9:
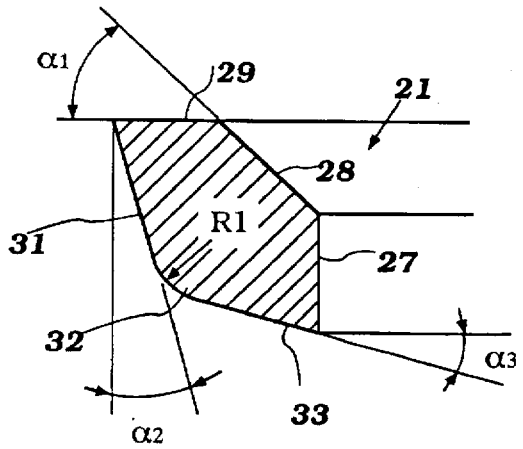
FIG. 9 is an enlarged cross-sectional view of the insert ring.

The construction of the insert ring 21, its shape and the shape of a cooperating recess 24 formed in the cylinder head 22 at the mouth of the passage 23 will now be described by primary reference initially to FIG. 9 as well as FIG. 1. FIG. 9 is an enlarged cross-sectional view of the intake valve seat insert ring 21.

Basically the insert ring 21 has a metallurgical construction as will be described. This insert ring 21 is bonded to the cylinder head material 22 by a relatively thin metallurgical bonding layer that is formed in a manner which will be described. Adjacent this bonding layer, there is formed a portion of the material of the cylinder head 22 which has been plastically deformed. It should be noted that the alloy of the cylinder head 22 is of the same chemical composition and same physical structure throughout, except for being slightly work hardened in the area adjacent the bonding layer. The preferred cylinder head materials will be described later.

Figure 7:
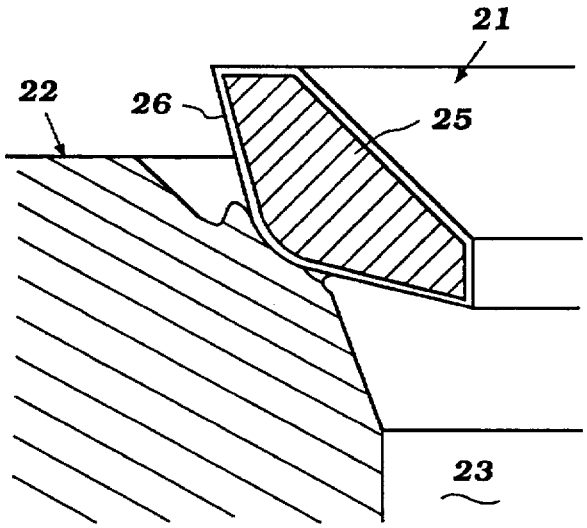
FIG. 7 is an enlarged cross-sectional showing the condition between FIGS. 2 and 3.

The insert ring 21, is formed from a Sintered base 25, see FIG. 7, which may having a coating material filled within its intercices and also on its external surface as will be noted, which coating is indicated at 26. This material is preferably formed from a good electrical conductor such as will be noted.

The insert ring 21 in accordance with this embodiment is formed with a cylindrical inner surface 27 that is relatively short in axial length and which merges into a tapered conical surface 28 which extends at an angle $\alpha_1$ for a substantially length. The surface 28, which is actually the pressing surface, as will be described, ends in an end surface 29.

A first, conical outer surface section 31 extends at an acute angle $\alpha_2$ to the axis of the cylindrical section 27 and merges at a rounded section 32 into an inclined lower end surface 33 which is formed at a n angle $\alpha_3$. The angles are such that $\alpha_1>\alpha_2\geqq\alpha_3$. In a preferred form $\alpha_1$ is 45° and the other two angles may be actually equal at 15°. The radius R1 of the curved section 32 is preferably 1 mm.

The cylinder head material 22, preferably as cast, is formed with a recess that is comprised of a first section 34 that is connected to a second section 35 that are joined by a horizontal surface that forms a projecting ledge 36 that contacts the rounded portion 32 of the insert ring 21 upon initial installation (FIG. 1). This tends to form a localized area that will begin the plastic deformation phase.

It has been noted that the coating serves the function of improving the electrical conductivity of the insert ring 21. Also, it has been noted that the coating performs additional functions. As should be apparent from the foregoing description, it is important that the bonding process not result in any alloying of the insert ring material and specifically that of the base 25 with the base material of the cylinder head 22.

The coating also serves the function of forming a eutectic alloy with the material of the cylinder head 22 which eutectic alloy has a lower melting point than either the melting point of the coating or that of the cylinder head material. As a result, the plastic deformation is accomplished with added ease and the metal can flow out during the pressing process as will be noted without large heat generation. In addition, the coating will react with any aluminum oxides that may be present on the surface of the recess of the cylinder head 22 so as to extrude these oxides and provide a purer finish.

Preferably, the coating is done in the manners to be specified and has a thickness in the range of 0.1–30 μm. Also, the cylinder head material of the body 22 is preferably an aluminum alloy as set forth in Japanese Industrial Standard (JIS) AC4C. Also the AC4B and AC2B aluminum alloys or other light alloys may be utilized.

Figure 2:
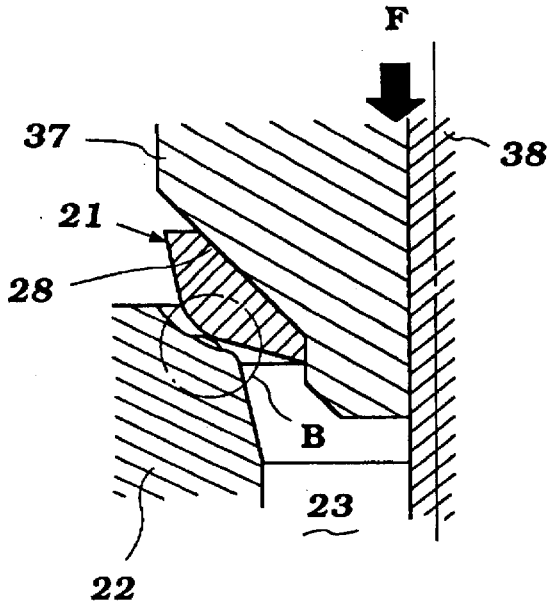

Beginning now to describe the pressing operation by reference to FIGS. 1–6. FIG. 1 shows the conditions when the insert ring is inserted and then centered. A pressing force is then applied by actuating a pressing electrode 37 received on a mandrel 38 into engagement with the insert ring 21 as seen in FIG. 2.

Figure 3:
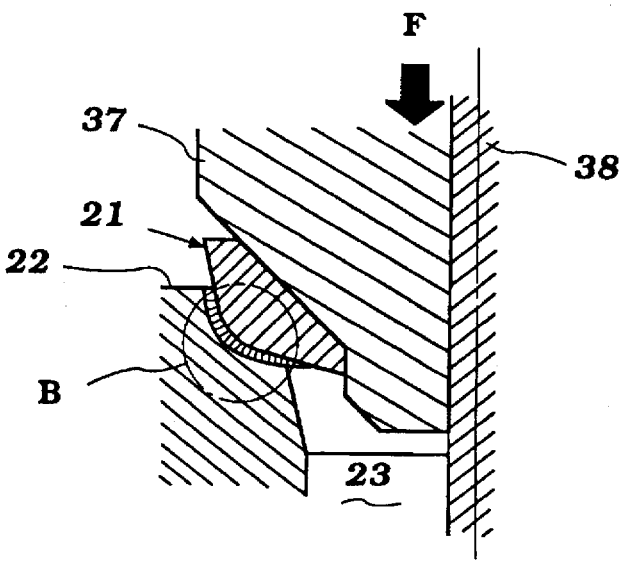

A pressing force is then applied at a force indicated at a first force as indicated at F. Pressure is maintained up until a time wherein an electric current flow through the joint is initiated as seen in FIG. 3. When this occurs, there will be a high electrical resistance due to the small contact area and a plastic deformation begins in the range indicated at B in FIG. 3 so as to displace the material of the cylinder head.

Figure 8:
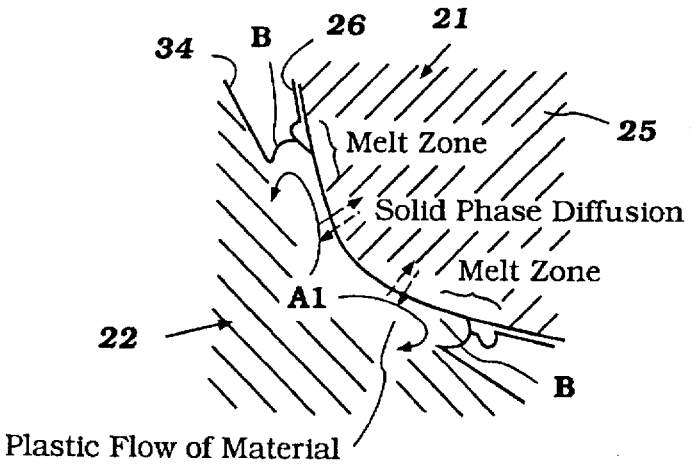
FIG. 8 is a further enlarged cross-sectional view of the area where the bond is forming in FIG. 7.

As the current is built up, the material will reach a temperature wherein the internal resistance is high enough to cause the coating layer 26 to defuse into the cylinder head material in the area shown in the range A1 in FIG. 8 so as to form the eutectic alloy that results in the area and which eventually causes displacement and a plastic deformation and the valve seat 21 will begin to become embedded in the material of the cylinder head 22.

The eutectic layer is displaced as indicated at B in FIG. 8 toward the area which will be removed from where the final valve seat will be formed. Said another way, this material will be later machined away.

Figure 4:
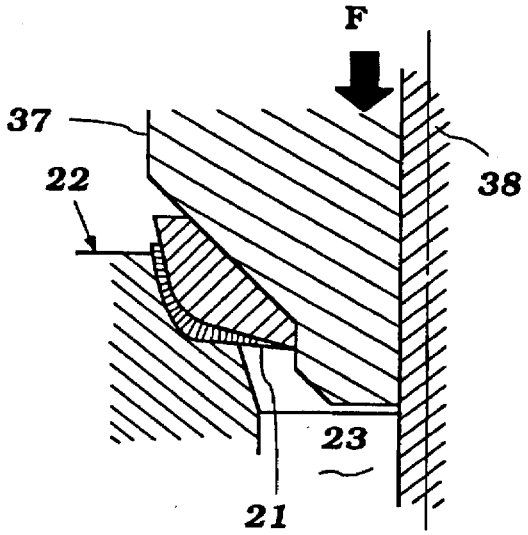
Figure 5:
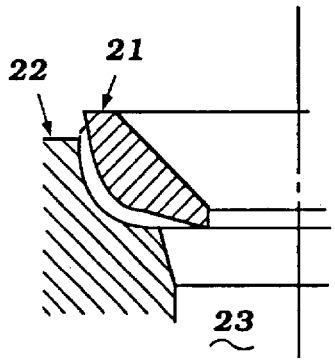
Figure 6:
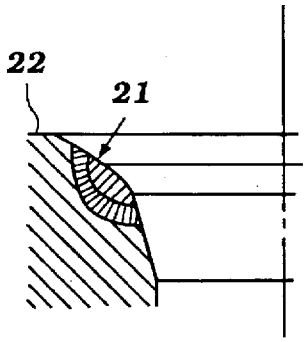

This pressing is continued after this still at a pressure during which time period the current flow is stopped at FIG. 4 while pressing is continued. Pressure is discontinued as shown in FIG. 5 and after final machining the final joint appears as shown in FIG. 6. It will be seen that substantially all of the eutectic alloy has been pushed from the area between the insert base and the base cylinder head material resulting in only the work hardened adjacent the joint and atomic bonding. In addition, the metallurgical bonding will be completed.

Having, thus, described the actual bonding process by which the metallurgical bond is formed, it should be readily apparent that it is important that the amount of heat applied is such that there is no alloying or melting between the base metal of the cylinder head casting 22 and that of the base 25 of the insert ring 21. The relationship between the various metals, i.e., that of the base cylinder head casting, referred to hereinafter and in the claims as the first material, that of the base material of the insert ring, referred to as the second material, and that of the coating, referred to as the third material, is very important. The cylinder head casting is, as has been noted, primarily formed as a aluminum alloy. Three particular alloys which are utilized for cylinder head castings have been identified as the Japanese Industrial Standards (J/S) AC2B, AC4B and AC4C. The chemical composition of these materials is set forth in the following Table 1.

TABLE 1

| Kind of | Chemical Composition (%) | | | | | | | | | | | |
|---|---|---|---|---|---|---|---|---|---|---|---|---|
| Alloy | Si | Fe | Cu | Mn | Mg | Zn | Ni | Ti | Pb | Sn | Cr | Al |
| AC3B | 5.0–7.0 | 1.0 | 2.0–4.0 | 0.50 | 0.50 | 1.0 | 0.35 | .2 | .2 | 0.10 | .2 | residue |
| AC4B | 7.0–10.0 | 1.0 | 2.0–4.0 | 0.50 | 0.50 | 1.0 | 0.35 | .2 | .2 | 0.10 | .2 | residue |
| AC4C | 6.5–7.5 | 0.55 | 0.25 | 0.35 | .25–.45 | 0.35 | 0.10 | .2 | .1 | 0.05 | .1 | residue |

Turning now to the second material, that of the base of the valve seat insert, this forms the actual rare surface for contact with the poppet-type intake and exhaust valves of the engine. Therefore, it must have a good wear resistance. In addition, since the valve itself is cooled primarily by the transfer of heat from the poppet valve head to the cylinder head through the valve seat insert, high heat conductivity of the valve seat insert is also important.

Also, because of the heat exchange through the valve seat insert and the fact that it operates at a high temperature, oxidation and deterioration due to oxidation is also important. Therefore, the insert material should be such as to have a high degree of resistance to oxidation. The preferred materials utilized for the valve seat insert, which is formed as noted as a sintered material from powder metallurgy, are ferrous-based, copper-based and/or nickel-based sintered materials.

The following table, Table 2, shows the various treatments so as to improve the wear resistance, heat conductivity and oxygen resistance of these materials.

TABLE 2

| Material | Function | Measure |
|---|---|---|
| Fe-based sintered material | wear resistance | • dispersion of hard phase → dispersion of hard phase containg Fe, Si, or Mo, or deposition of carbide complex containing Cr, W, Co, or V<br>• inclusion of solid lubricant → addition of Cu, or impregnation of Cu or Pb |
| | heat conductivity | addition of Cu, or infiltration of Cu |
| | oxidation resistance | addition of Cr or Ni |
| Cu-based sintered material | wear resistance | • dispersion of hard phrase → dispersion of hard phase containing Fe, Si, or Mo<br>• increase of matrix hardness → addition of Co, Al, Ni, Si, B, Fe, or Mn, or dispersion of fine deposit through addition of Be, Ti, or Cr |
| | heat conductivity | satisfactory because of Cu-base material |
| | oxidation resistance | addition of Al, Be, Ni or Cr |
| Ni-based sintered material | wear resistance | formation of fine oxide film |
| | heat conductivity | addition of Cu |
| | oxidation resistance | addition of Cu, satisfactory because of Ni-base material |

Finally, the matter of electrical heat conductivity of the valve seat insert is also important. If the conductivity of the valve seat insert is too low, then the electrical current flowing through the valve seat insert during the aforenoted bonding process will generate too much heat and there becomes the risk of alloying, which is not desired. In addition, there will be hardening due to phase transformation to form a martensitic structure and the desired characteristics of the valve seat insert will be lost, particularly if formed from ferrous-based materials. On the other hand, if the conductivity is too high, then insufficient heat will be produced to provide bonding.

In view of the fact that there is applied pressure on the valve seat insert during the bonding process and the application of heat, the valve seat insert also should have good high temperature strength. In order to provide the optimum material having these characteristics, reference may be made to the following Table 3 which shows the way in which electrical conductivity, heat conductivity and high temperature strength can be promoted with the preferred ferrous, copper or nickel-based sintered materials.

TABLE 3

| Material | Function | Measure |
|---|---|---|
| Fe-based sintered material | electric conductivity | infiltration of Cu |
| | heat conductivity | addition of Cu, or infiltration of Cu |
| | high temperature strength | addition of Ni, Co, Mo, V, or Mn |
| Cu-based sintered material | electric conductivity | satisfactory because of Cu-based material |
| | heat conductivity | satisfactory because of Cu-based material |
| | high temperature strength | • dispersion of hard phase → dispersion of hard grain containing Fe, Mo, or Cr<br>• increase of matrix hardness → addition of Co, Al, Ni, Si, B, Fe, or Mn, or dispersion of fine deposit through addition of Be, Ti, or Cr |
| Ni-based sintered material | electric conductivity | addition of Cu |
| | heat conductivity | additionof Cu |
| | high temperature strength | satisfactory because of Ni-based material |

Figure 10:
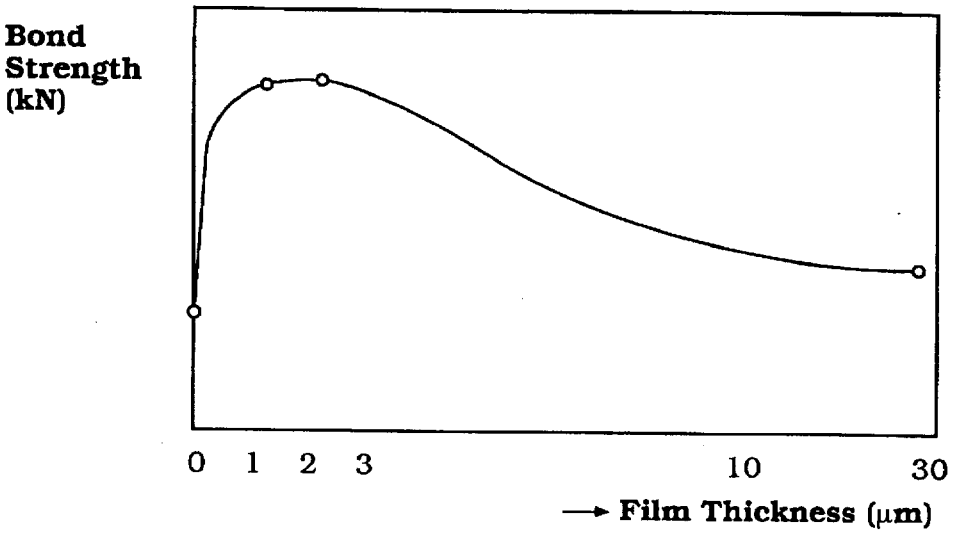
FIG. 10 is a diagram showing the bond separation strength in kilogram newtons in relation to the thickness of the coating layer in μm.

The material of the coating also is very important as well as its thickness. FIG. 10 is a graphical view showing how the thickness of the coating affects the bond strength. The bond strength is measured in the term of kilogram newtons which is the mount of force necessary to remove the bonded insert from the cylinder head. As may be seen, when the film thickness is in the range of 0.1 to 30 μm and preferably in the preferred range of 0.1 to 3 μm, the bond strength is quite high.

As has been noted, the coating materials are preferably formed from either copper, tin, zinc, silver, aluminum or alloys thereof such as copper, zinc or aluminum silicon alloys, the desired characteristics can be obtained. In addition, the materials can be applied in a variety of manners and the following table (Table 4) shows the manner of forming the film or coating on the insert depending upon the type of material applied:

TABLE 4

| Film Forming Method | Materials for Coating |
|---|---|
| Electroplating | Cu, Sn, Zn, Ag, Cu—Zn |
| Hot Dipping | Al, Al—Si, Sn, Zn |
| Physical Vapor Deposition | Cu, Ag, Si |
| Chemical Vapor Deposition | Cu, Ag, Si |
| Flame Spraying | Cu, Sn, Zn, Ag, Al, Al—Si, Cu—Zn |

Figure 11:
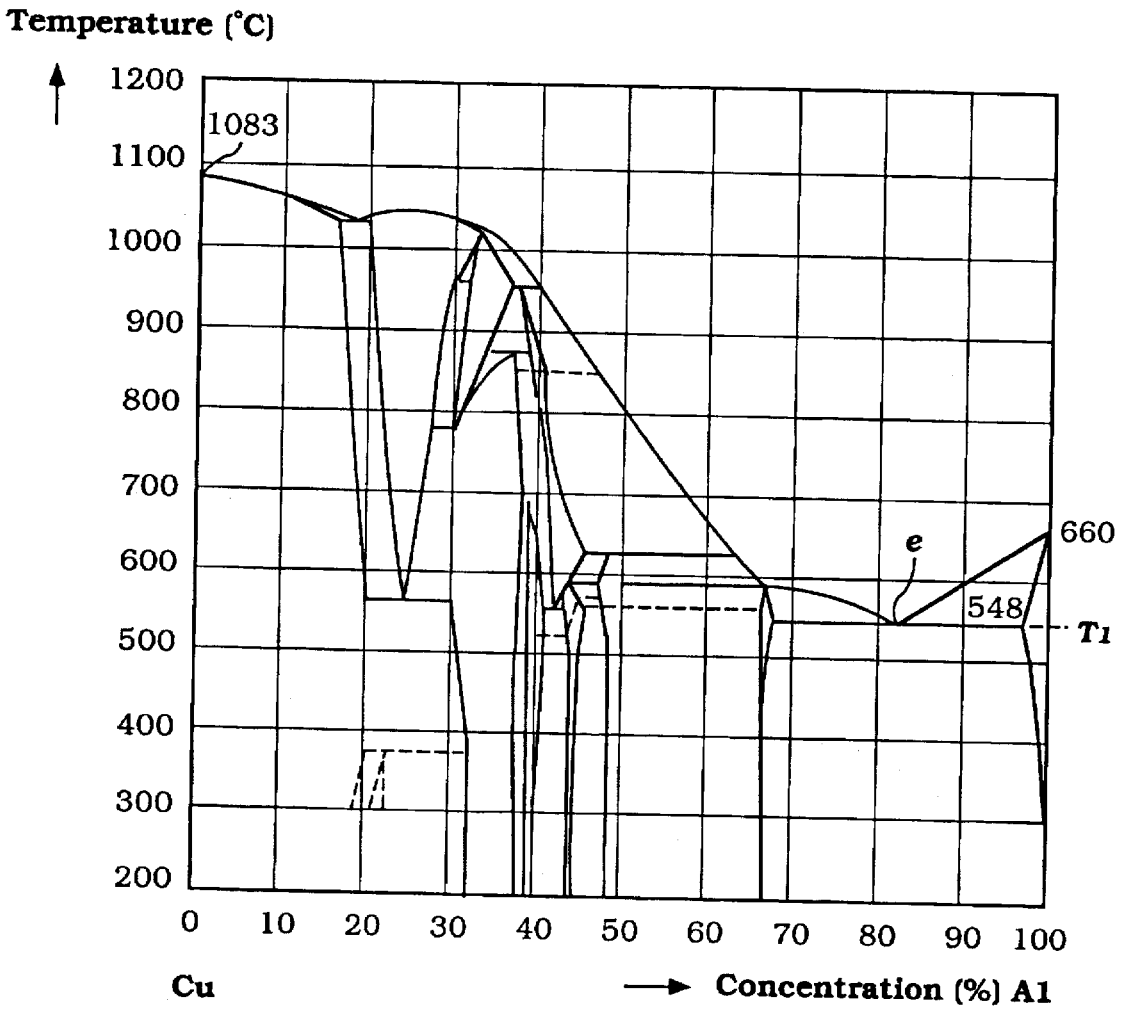
FIG. 11 is a phase diagram showing the melting points of two materials which may be utilized for the cylinder head casting and coating, respectively, namely, aluminum and copper, and shows how the melting point of the eutectic alloy is lower than that of either of these materials.

The way in which the eutectic alloys may be formed in accordance with the invention for the various materials will now be described by the phase diagrams of FIGS. 11–15. Referring first to FIG. 11, this is a phase diagram that shows the use of a copper coating material and a cylinder head formed primarily of aluminum and specifically those aluminum alloys AC2B, AC4B or AC4C previously described. As may be seen, the melting points of aluminum and copper are, respectively, 660° C. and 1083° C. However, the temperature of melting of eutectic point e is 548° C. Thus, this is lower than that of either of the base materials and, hence, good bonding can result without alloying.

Figure 12:
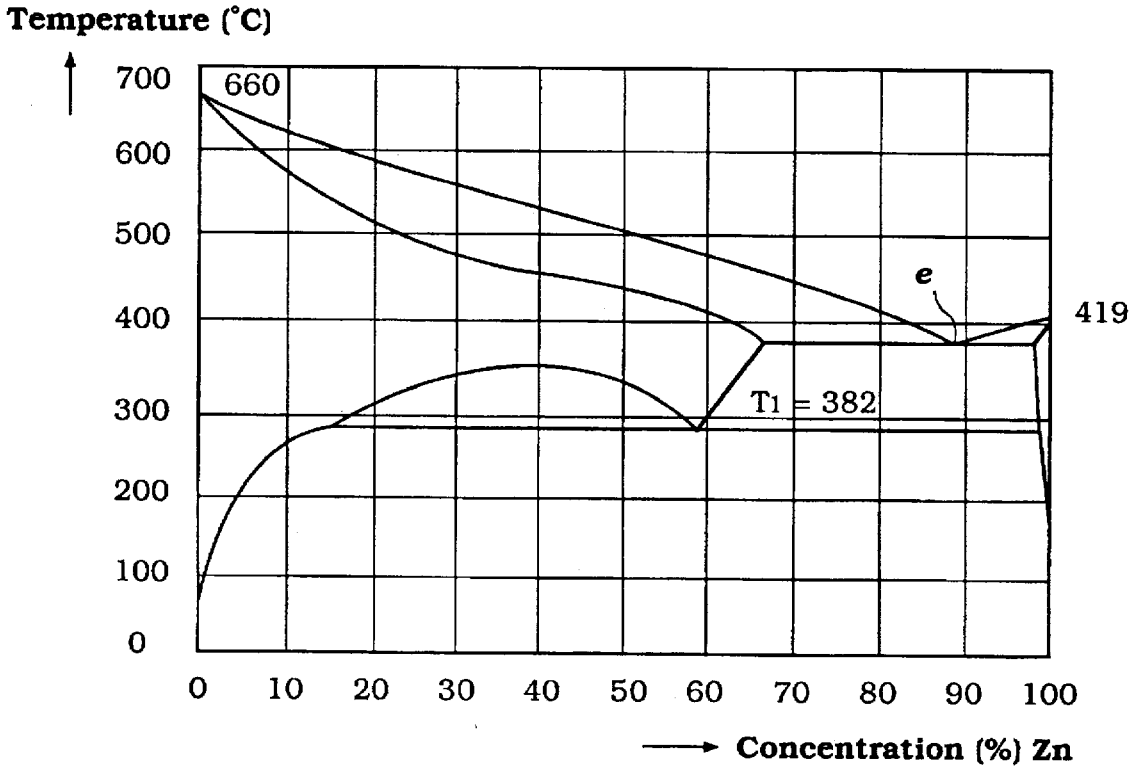
FIG. 12 is a phase diagram, in part similar to FIG. 11 and shows the situation for an aluminum cylinder casting and a coating of zinc.

FIG. 12 shows a phase diagram utilizing an aluminum cylinder head and a zinc coating. The melting points of aluminum is 660° C. as previously noted and that of zinc is 419° C. However, at the eutectic point e the resulting alloy has a melting point of 382° C. which is lower than that of either of the base materials. Therefore, the good bonding can result utilizing this material.

Figure 13:
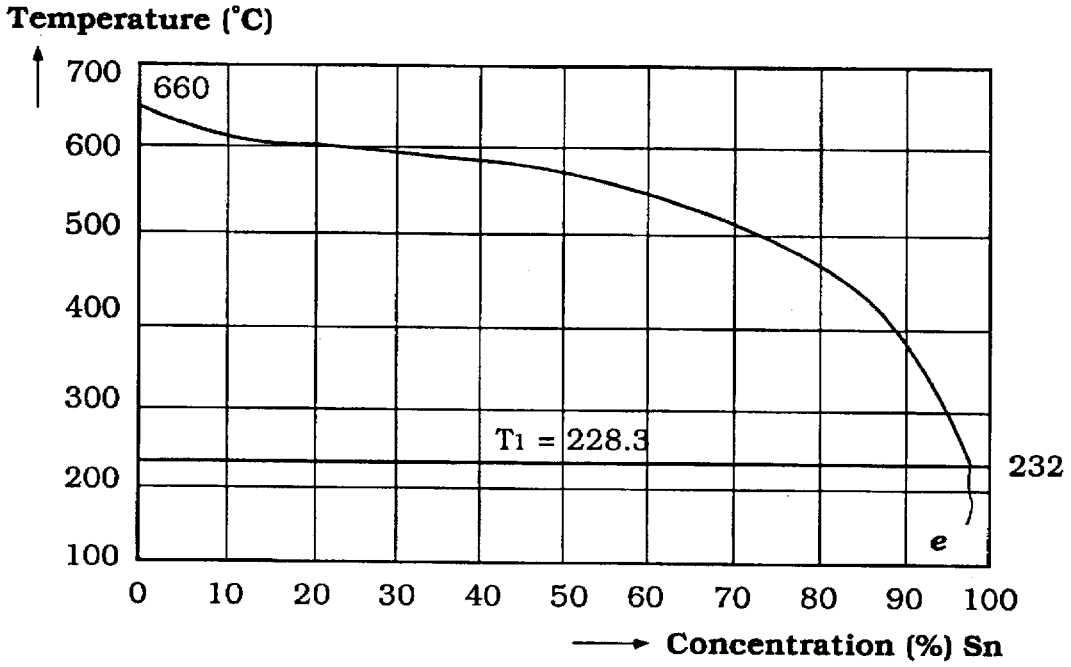
FIG. 13 is a phase diagram showing an aluminum cylinder head casting and a tin coating.

FIG. 13 is a phase diagram showing the use of an aluminum cylinder head with a tin alloy coating. The melting point of tin is 232° C. However, the eutectic alloy resulting at the point e has a melting point of 228.3° C. which is lower than that of the tin and will below that of aluminum (660° C.).

Figure 14:
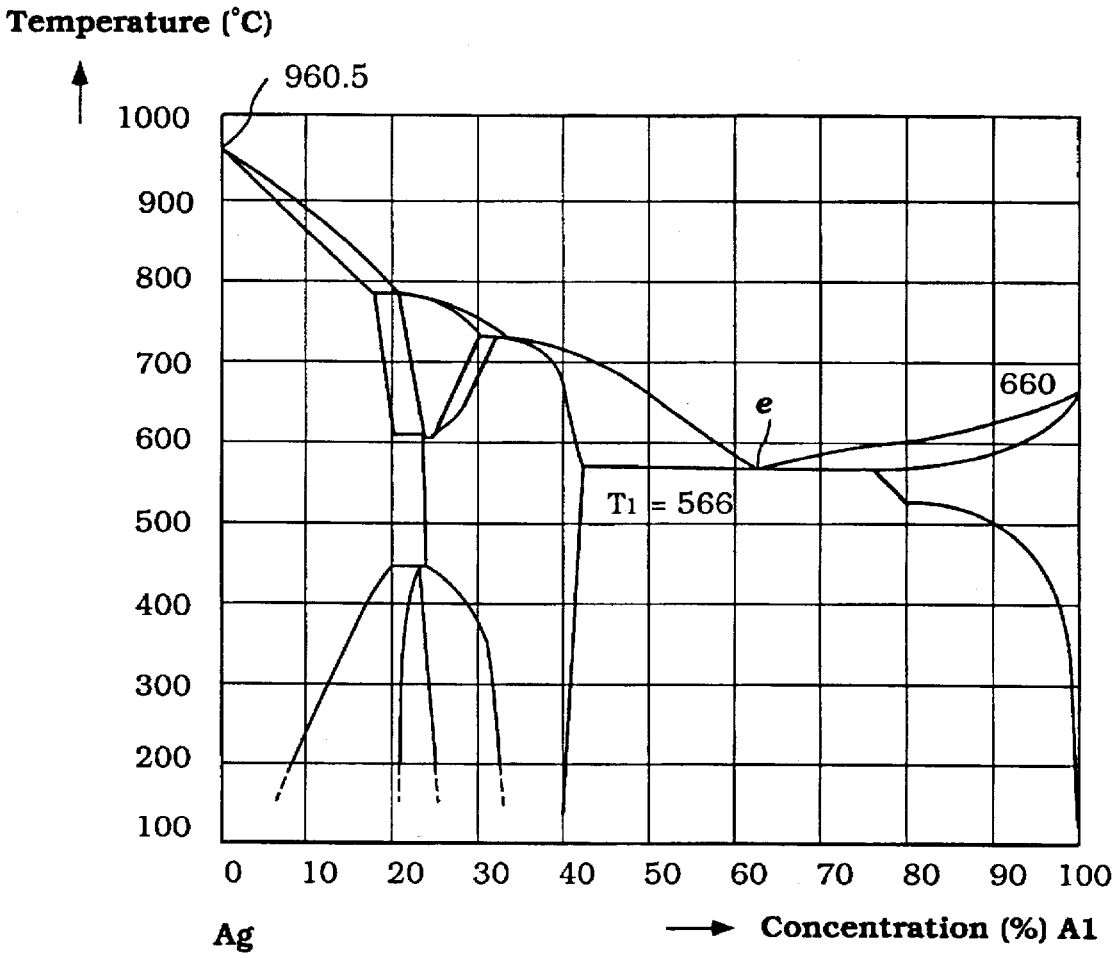
FIG. 14 is a phase diagram showing an aluminum cylinder head casting and a silver coating.

FIG. 14 is a phase diagram showing the use of aluminum with a silver coating. Silver has a melting point of 950.5° C. The eutectic alloy formed at the point e, however, has a melting point of 566° C. which is lower than that of aluminum (660° C.) or of silver and, hence, this coating material also can be successfully utilized.

Figure 15:
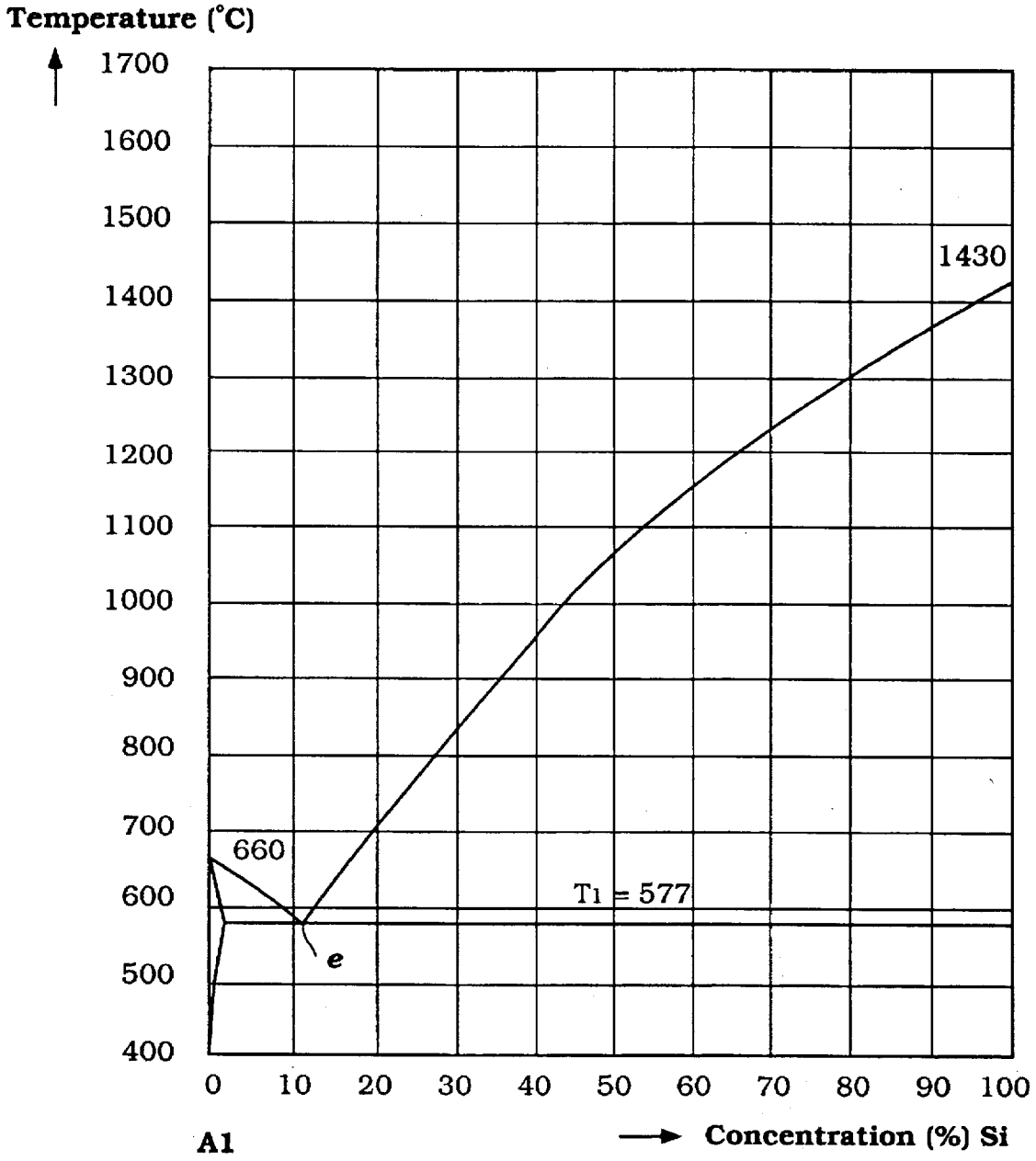
FIG. 15 is a phase diagram showing an aluminum cylinder head casting and a silicon coating.

Finally, it will be seen from FIG. 15 that, if a silicon coating is employed, the same results can be obtained. Silicon has a melting point of 1430° C., but the eutectic alloy formed at the point e has a melting point of 577° C. which is lower obviously than that of silicon and also lower than the base aluminum (660° C.).

Thus, from the foregoing description it should be readily apparent that the utilization of the described materials and having the various treatments described herein are effective in providing a very good bonded valve seats. Of course the foregoing description is that of preferred embodiments of the invention, and various changes and modifications may be made without departing from the spirit and scope of the invention, as defined by the appended claims.

What is claimed is:

1. A valve seat insert for forming an electrically resistance heated, bonded valve seat with a casting formed from a first material selected from the group consisting of aluminum and an aluminum alloy, said valve seat insert being comprised of a base formed from a second material selected from the group consisting of sintered ferrous, copper and nickel, and a coating on at least the surface of said base to be bonded to said casting and formed from a third material selected from the group consisting of copper, tin, zinc, silver, aluminum, or silicon or an alloy thereof, said third material forming an eutectic alloy with said first material having a lower melting point than that of either said first or said third materials.

2. A valve seat insert as set forth in claim 1, wherein the base material is treated so as to improve its electrical conductivity.

3. A valve seat insert as set forth in claim 2, wherein the treatment of the base material to improve its conductivity includes the infiltration of a more highly conductive material into the interstices of the sintered material.

4. A valve seat insert as set forth in claim 3, wherein the material infiltrated comprises copper.

5. A valve seat insert as set forth in claim 3, wherein the base material is treated so as to improve its heat conductivity.

6. A valve seat insert as set forth in claim 5, wherein the base material is treated so as to increase its high temperature strength.

7. A valve seat insert as set forth in claim 6, wherein the high temperature strength is obtained by adding an alloying material selected from the group consisting of nickel, cobalt, molybdenum, vanadium and manganese.

8. A valve seat insert as set forth in claim 3, wherein the base material is treated so as to increase its high temperature strength.

9. A valve seat insert as set forth in claim 1, wherein the base material is treated so as to improve its heat conductivity.

10. A valve seat insert as set forth in claim 9, wherein the base material is treated so as to increase its high temperature strength.

11. A valve seat insert as set forth in claim 1, wherein the base material is treated so as to increase its high temperature strength.

* * * * *